United States Patent [19]

Stab

[11] Patent Number: 4,781,367

[45] Date of Patent: Nov. 1, 1988

[54] FOLDING DEVICE WITH PIVOTABLE BUCKLE CHUTE ROLL

[75] Inventor: Rudolf Stab, Frankenthal, Fed. Rep. of Germany

[73] Assignee: Albert-Frankenthal AG, Frankenthal, Fed. Rep. of Germany

[21] Appl. No.: 53,381

[22] Filed: May 22, 1987

[30] Foreign Application Priority Data

Jun. 5, 1986 [DE] Fed. Rep. of Germany ..... 3618921

[51] Int. Cl.[4] ..... B42C 1/00

[52] U.S. Cl. ..... 270/45; 493/420

[58] Field of Search ..... 270/45, 46; 493/405, 493/419, 420, 421

[56] References Cited

U.S. PATENT DOCUMENTS

| | | | |
|---|---|---|---|
| 911,542 | 2/1909 | Owens | 493/420 |
| 2,023,531 | 12/1935 | Kleinschmit et al. | 493/420 |
| 3,008,707 | 11/1961 | McGarvey | 493/421 |
| 3,265,382 | 8/1966 | Sherman | 270/45 |
| 3,416,785 | 12/1968 | Sherman | 270/45 |
| 3,495,818 | 2/1970 | Marin | 493/420 |
| 3,698,705 | 10/1972 | Funk et al. | 493/420 |
| 3,961,781 | 6/1976 | Funk | 493/420 |
| 4,573,672 | 3/1986 | Lehmann et al. | 270/45 |
| 4,647,029 | 3/1987 | Ohmori | 270/45 |
| 4,717,134 | 1/1988 | Iida et al. | 270/45 |

FOREIGN PATENT DOCUMENTS 3520965 12/1986 Fed. Rep. of Germany .

*Primary Examiner*—Eugene H. Eickholt

*Attorney, Agent, or Firm*—Edwin D. Schindler

[57] ABSTRACT

In the context of a folding device comprising at least one transverse folding part which is supplied and discharged by feed tapes and is in the form of a buckle folder with a buckle passage flanked by two outer rolls cooperating with a center roll with the formation of feed nips, such folder having a set of tapes running through it over the center roll, a greater degree of adaptability to the processing of different products and of possibilities of modification of the feed paths may be ensured if the outer roll on the delivery side may be pivoted away from the center roll so as to open up and render ineffective the delivery feed roll nip and the buckle passage may be shifted so that its inlet is over the inlet-side feed plane of the tape set running over the center roll.

12 Claims, 2 Drawing Sheets

FOLDING DEVICE WITH PIVOTABLE BUCKLE CHUTE ROLL

BACKGROUND OF THE INVENTION

The invention relates to a folding device comprising at least one transverse folding part which is supplied and discharged by feed tapes and is in the form of a buckle folder with a buckle passage flanked by two outer rolls cooperating with a center roll with the formation of feed nips, such buckle folder having a set of tapes running through it over the center roll.

An arrangement of this sort is described in the German patent application No. P 3,520,965, in which the buckle folder device is not able to be put out of operation. The products running through the buckle folder are therefore necessarily transversely folded. Although in this earlier device there is an exit branch conveyor means extending from the tape conveyor feeding a second buckle folder so that the products may be delivered after only being folded once, there is frequently a desire to deliver products, which have been folded only once, at a position coming after the second transverse folder means. This is not possible with the known device.

SUMMARY OF THE INVENTION

Taking this state of the art as a starting point, one object of the invention is to devise a folding device of the initially specified type which is highly adaptable as regards the variety of products able to be processed.

A further aim of the invention is to provide such a folding device in which the path taken by the products through it may be more or less radically modified.

In order to achieve these or other objects appearing from the ensuing description and claims, the folding device is characterized in that the outer roll on the delivery side may be pivoted away from the center roll so as to open up and render ineffective the delivery-side feed roll nip and the buckle passage may be shifted so that its inlet is over the inlet-side feed plane of the tape set running over the center roll.

These measures ensure that the buckle folding part designed on these lines may be made operative and inoperative as desired and in the inoperative condition the products arriving on the feed tape conveyor may pass by it without folding. The invention thus advantageously for example offers the possibility of delivering products which have been only once folded transversely, at a point downstream, in the direction of product feed, from a second transverse folder.

A particularly simple and rapid resetting of the folding device, which means that it is highly ergonomic in design, is possible if the outer roll on the delivery side and the buckle passage are mounted on bearing elements able to pivot about the axis of the outer roll on the input side. The resetting of the entire subassembly may in this respect be accomplished by means of an actuator acting on the bearing elements, the end positions being best defined by the provision of terminal abutments.

In order to increase the operational reliability and the freedom from stoppages it is an advantage if, in the opened up or non-operational condition of the feed roll nip, the inlet of the buckle passage may be closed by fingers which are preferably detachably arranged on the pivoting bearing elements and which span the two outer rolls. The fingers form a more or less stationary guide means, which prevents any deflection of the products in the zone between the two spaced outer rolls.

In accordance with a further advantageous feature of the invention the outer roll on the delivery side is followed by a bend roll also arranged on the bearing elements to pivot with the outer roll and which extends into the tape supporting means so as to bend the tapes and whose distance on the tape supporting means from the adjacent outer roll is at least equal to the maximum depth of the buckle passage. This ensures that in the part of the folding device adjacent to the tape bend guaranteeing an excellent stability of the products, the same are only bent or deflected when they have already issued from the buckle folder, this being of assistance in avoiding trouble conditions when the buckle folder is operational.

Further convenient features and improvements provided by the present invention will be gathered from the ensuing description of one working example as shown in the figures and from the claims.

LIST OF THE VIEWS OF THE DRAWINGS

DETAILED ACCOUNT OF WORKING EMBODIMENT OF THE INVENTION

Figure 1:
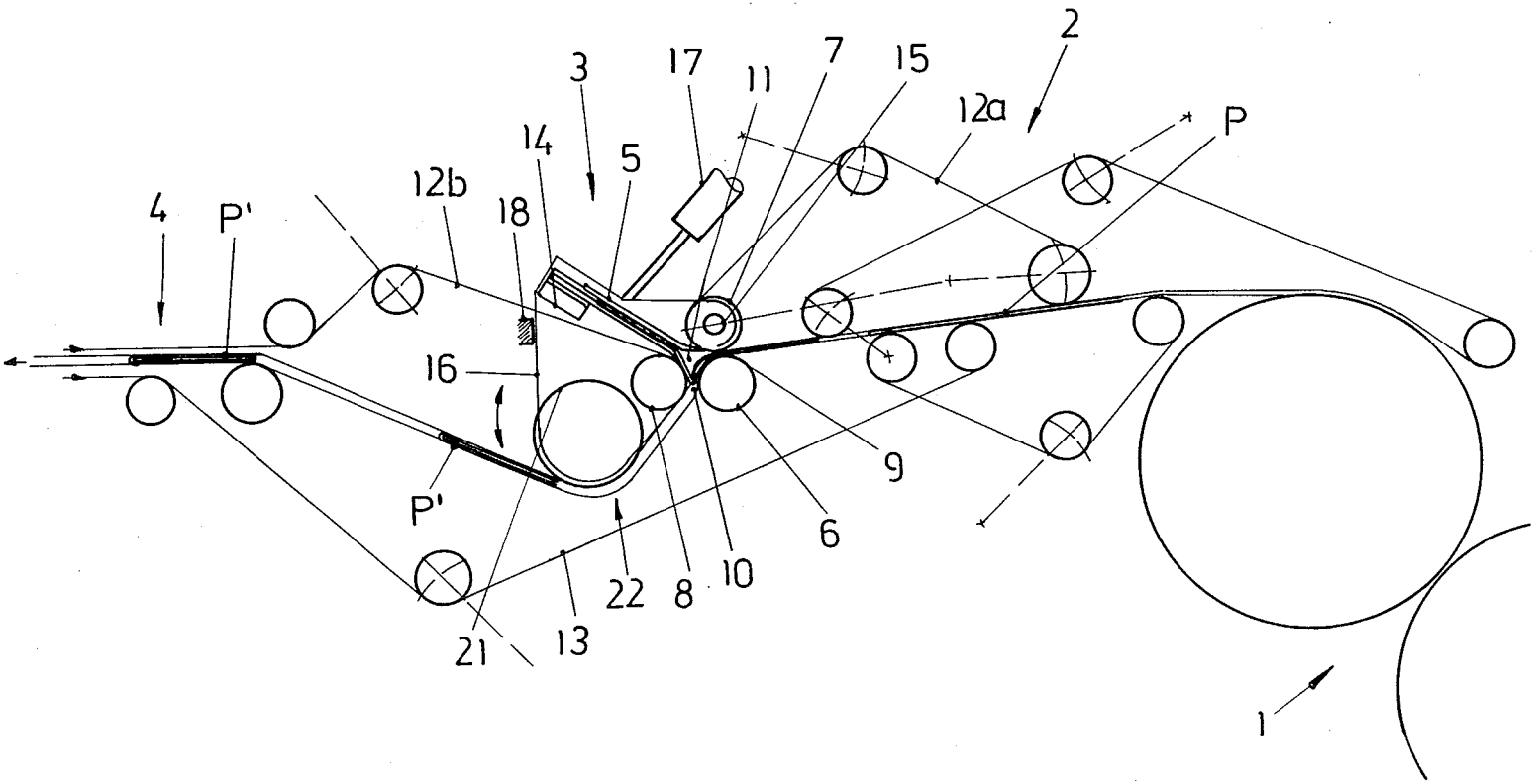
FIG. 1 is a side view of a folding device in accordance with the invention with the second folder unit therein, the buckle folder, in the operational state.
Figure 2:
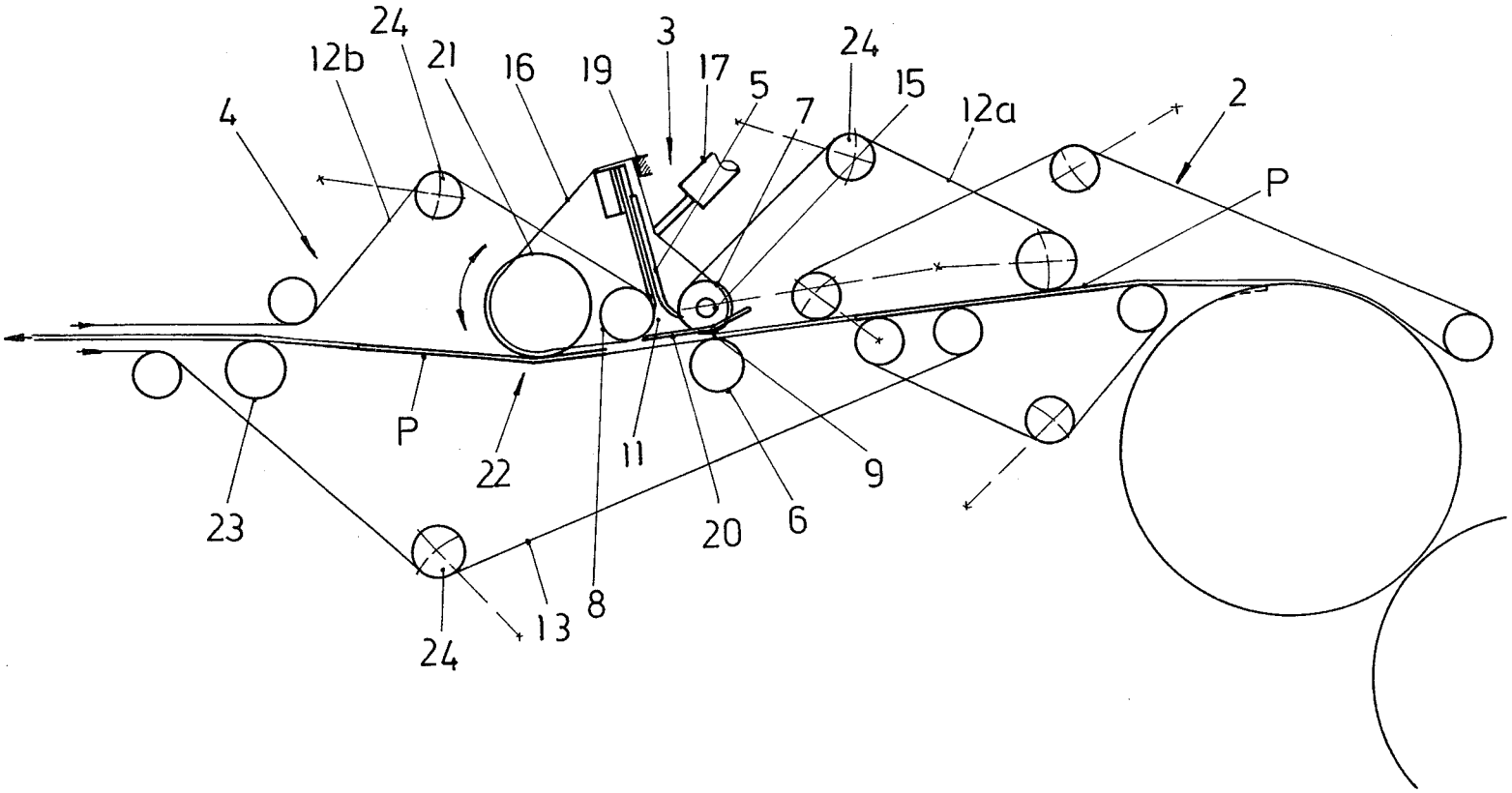
FIG. 2 shows the arrangement in accordance with FIG. 1 after the second part, the buckle folder, has been put out of operation.

The folding device illustrated in FIGS. 1 and 2 comprises a first folder unit, which may be conventional, and in the preset case is designed as a jaw folder unit 1, and a second transverse or right angle buckle folder unit 3 connected with the first folder unit 1 by a tape conveyor 2. The buckle folder unit 3 may be connected via a tape conveyor 4 running out of it with a product delivery unit (not illustrated in detail) or with a further folder unit for the production of a third longitudinal or right angle fold. Once they have been transversely folded the products are lifted clear of the folding jaws of the jaw folder unit 1 by lifting fingers and passed into the tape conveyor 2, which in the present case may be designed in a conventional manner so that it causes a slow-down of the products.

The buckle folder unit 3 consists of a buckle passage 5 more or less forming a cul-de-sac for the fed products P and of three rolls 6, 7 and 8 driven to rotate at the same speed and which in the operational condition shown in FIG. 1 of the folder unit are so set in contact with each other that at the circumference of the center roll 6 there are on the one hand two feed nips 9 and 10 respectively offset from each other by approximately 90° about the said roll 6 so as to be opposite to the inlet aperture of the buckle passage 5, and on the other hand an opening forming the inlet to the buckle passage and being opposite to the center roll 6 and delimited by the two outer rolls 7 and 8, which are spaced from each other in the circumferential direction. The rolls 6 through 8 are so driven in the active setting of the device that the feed nip 9 nearer to the first transverse folder unit 1 acts as a draw-in nip into which the feed plane of the tape conveyor 2 runs and the second feed nip 10 acts as the outlet roll nip which is adjacent to the tape conveyor 4. The two outer rolls 7 and 8 at the same time constitute the bend rolls of the upper tape sets 12*a* and 12*b*, respectively, which cooperate with the lower tape set 13 (running through the buckle folder unit 3 and running over the center roll 6) in forming the tape guide conveyors 2 and 4, respectively. In the operational or activated condition shown in FIG. 1 the two outer rolls 7 and 8 are able to be set in relation to the center, stationarily arranged roll 6 for adaptation of the clearance size of the feed nips 9 and 10.

The buckle passage 5 extending along the full breadth of the machine is inclined in relation to the feed plane, running into the feed nip 9, of the tape conveyor 2 away from its aperture 11, forming the inlet, in an upward direction. A further adaptation to the different conditions resulting from the processing of products with different thicknesses is made be possible by a pivoting or setting of the buckle passage 5. The latter may for this purpose be mounted on a pivotally or adjustable crosspiece 14. The buckle passage 5 is defined by the interior of a configuration which in longitudinal section is generally U-like and is open towards the center roll 6 and is formed by spaced parallel guide walls forming the legs of the letter U and extending over the full width of the machine, and furthermore by a stop rail spanning the space between these walls and defining the depth of the buckle passage. The rail may be adjusted. It also extends across the full width of the machine. Adjacent the ends near to the roll it is possible for the guide walls to be made with a taper and to be bent upwards in order to form a V-like inlet and delivery part opening towards the center roll 6.

In the operational condition of the buckle folder unit 3 shown in FIG. 1, the products P with a single transverse fold, are pulled in via the inlet feed nip, and shoot into the buckle passage 5 and are then drawn off via the delivery feed nip 10 with the formation of a second transverse fold so that the tape coveyor 4 propels products $P^1$ which have two transverse folds therein. In order to deliver products with only one transverse fold therein downstream from the buckle folder unit 3 the tape conveyor 4 may be put out of its operational condition, it is possible for the buckle fold unit 3 to be moved into the non-operational position shown in FIG. 2, in which the products P, which have been folded only once, shoot past the buckle passage 5. For this purpose the outer roll 8 on the delivery side and the buckle passage 5 are mounted on common bearing elements 16 able to pivot about the shaft 15 of the outer roll on the inlet or feed side so that the roll and the passage may be swung upwards from the basic setting shown in FIG. 1 into that shown in FIG. 2 for putting the buckle folder unit out of operation, in which position the delivery side outer roll 8 is moved so far clear of the stationarily arranged center roll 6 that there is no feed or product engaging nip between these two rolls. I. e. the delivery roll nip no longer exists and the buckle passage 5 is lifted to such an extent that its inlet 11 or aperture is at a higher level than the feed plane of the tape conveyor 2 running into the inlet feed nip 9.

The pivoted, non-operative setting of the subassembly on the bearing elements 16 as shown in FIG. 2 is so selected that the tape set 13 running under the buckle passage inlet 11 is not bent or deflected at the center roll 6 so that the feed plane of the tape conveyor 2 extends without any bend near the center roll 6 under the two outer rolls 7 and 8. The setting of the adjustable subassembly may be caused by actuators 17, as for example in the form of a cylinder and piston unit or of a drive screw, acting on the bearing elements 16. The terminal settings shown in FIGS. 1 and 2 may be defined by having end stops 18 and 19, respectively, which cooperate with the bearing elements 16.

In the non-operational condition of the working example of the invention shown in FIG. 2 the buckle passage inlet 11 is able to be shut off by a guide means 20 spanning the distance between the two outer rolls 7 and 8 to further enhance operational reliability. This guide means 20 may simply be in the form of a rake which is able to be locked onto the pivoting bearing elements 16 and is made up of adjacent fingers.

In order to ensure dependable feed of the products P near the buckle folder unit 3, which is able to be made non-operational, there is in the present case a bend roll 21 following the outer delivery roll 8, such roll 21 being mounted together with the adjacent outer roll 8 and the buckle passage 5 on the bearing elements 16 and confluent with the tape conveyor 4 leaving the buckle folder unit 3 with the formation of a bend 22 in the tapes so as to more stably guide the products being conveyed. In the non-operational position shown in FIG. 2 in which the products P with one transverse fold are intended to simply run through the non-operative buckle folder unit 3, the bend roll 21 cooperates with a following, stationary bend roll 23 and with the two outer rolls 7 and 8 of the buckle folder unit 3 causes the formation of a bend in the tapes with a relatively large angle. This angle becomes smaller and smaller, i. e. more acute, on downwardly swinging the pivoting subassembly into the operational position shown in FIG. 1 and this ensures a very reliable feeding action. The distance of the bend roll 21 from the adjacent outer roll 8 of the buckle folder unit 3 is so selected in this connection that the length of the tape guide section as delimited by the bend roll 21 and the adjacent outer roll 8 is equal to at least the depth of the buckle passage 5, that is to say at least the maximum format to be processed. This ensures that when buckle folding is taking place the products, then furnished with two transverse folds, are only bent at the bend 22 in the tapes after they have come out of the buckle foler unit 3.

The tape set 13 running through the buckle folder unit 3 and running on the center roll 13 and the upper tape sets **12*a* and 12*b* on the in- and outlet sides for cooperation with the tape set 13, run over pivotally mounted slack take-up rolls 24, which also make possible the above-noted resetting of the position of the pivoting subassembly. The drive of the rolls 6, 7 and 8 of the buckle folder unit to run at the same speed may be by way of a belt with teeth on two sides and which mesh with pinions at the ends of the rolls. The set 12*a* and 12*b* of tapes are driven via the rolls 7 and 8, acting as bend rolls, of the buckle folder unit 3. The drive of the rolls of the buckle folder unit 3 therefore continues in the said non-operational condition so that the tape set 13** may be driven therefrom.

I claim:

1. A folding device comprising at least one transverse folding unit in the form of a buckle folder, tape conveyors for the feed of printed products to the folding unit and for the delivery of such products therefrom, said folding unit being made up of two outer feed and delivery rolls on a delivery side thereof and of a center roll adapted to cooperate with such outer rolls with the formation of product-engaging and product-feeding nips, of means defining a buckle passage flanked by said outer rolls, and of a set of tapes in running engagement with said center roll, said outer roll on the feed side of such folding unit being able to be pivoted away from such center roll so as to render inoperative said feed nip defined therewith and said buckle passage is able to be so moved that an inlet end thereof is moved clear of said tape set adapted to run over said center roll.

2. The folding device as claimed in claim 1 comprising common bearing elements on which said outer delivery roll and said buckle passage are mounted for pivotal motion thereof.

3. The folding device as claimed in claim 2 wherein said delivery outer roll and said buckle passage are able to pivot about an axis of said feed outer roll.

4. The folding device as claimed in claim 2 wherein said buckle passage and said delivery outer roll form a subassembly, said device further comprising an actuator for pivoting said subassembly on said bearing elements.

5. The folding device as claimed in claim 4 wherein said actuator comprises a piston and cylinder means and terminal abutments for limiting pivoting motion of said subassembly.

6. The folding device as claimed in claim 1 comprising a bend roll placed downstream, in the direction of product feed, from said delivery outer roll and engaging one of said tape conveyors to form a bend therein, said bend roll being able to be pivoted together with said outer roll.

7. The folding device as claimed in claim 6 wherein said bend roll is also mounted on said bearing elements.

8. The folding device as claimed in claim 6 wherein the distance on the tape conveyor side between the bend roll and the adjacent delivery outer roll is equal to at least the maximum depth of the buckle passage.

9. The folding device as claimed in claim 1 comprising pivoting slack-take up rolls over which at least the one of said tape conveyors forming a delivery tape means is trained.

10. The folding device as claimed in claim 1 comprising a guide means adapted to shut off said inlet end of said buckle passage when said feed nip on the outlet side of said folder unit is non-operational.

11. The folding device as claimed in claim 10 wherein said guide means is detachably mounted on said bearing elements and comprises fingers.

12. The folding device as claimed in claim 1 comprising a further transverse folding means placed upstream, in the direction of product feed, from said folding unit

* * * * *